US011359563B2

(12) United States Patent
Braun et al.

(10) Patent No.: US 11,359,563 B2
(45) Date of Patent: Jun. 14, 2022

(54) METHOD FOR DETERMINING THE CURRENT TRIMMING OF THE INTAKE TRACT OF AN INTERNAL COMBUSTION ENGINE DURING OPERATION

(71) Applicant: Vitesco Technologies GMBH, Hannover (DE)

(72) Inventors: Tobias Braun, Undorf/Nittendorf (DE); Frank Maurer, Regenstauf (DE); Matthias Delp, Bad Abbach (DE)

(73) Assignee: Vitesco Technologies GmbH, Regensburg (DE)

( * ) Notice: Subject to any disclaimer, the term of this patent is extended or adjusted under 35 U.S.C. 154(b) by 32 days.

(21) Appl. No.: 16/696,489

(22) Filed: Nov. 26, 2019

(65) Prior Publication Data

US 2020/0300185 A1 Sep. 24, 2020

Related U.S. Application Data

(63) Continuation of application No. PCT/EP2018/064237, filed on May 30, 2018.

(30) Foreign Application Priority Data

Jun. 2, 2017 (DE) ..... 10 2017 209 386.2

(51) Int. Cl.
*F02D 41/00* (2006.01)
*F02B 27/00* (2006.01)
(Continued)

(52) U.S. Cl.
CPC ..... *F02D 41/009* (2013.01); *F02B 27/005* (2013.01); *F02D 41/0002* (2013.01);
(Continued)

(58) Field of Classification Search
CPC .... F02D 41/0002; F02D 41/009; F02D 41/22; F02D 41/2432; F02D 2041/001;
(Continued)

(56) References Cited

U.S. PATENT DOCUMENTS 4,617,897 A * 10/1986 Sasaki ..... F02B 27/0257 123/432
4,829,941 A * 5/1989 Hitomi ..... F02B 75/22 123/184.31
(Continued)

FOREIGN PATENT DOCUMENTS

CN 1977099 A 6/2007
DE 3506114 A1 9/1986
(Continued)

OTHER PUBLICATIONS

International Search Report and Written Opinion dated Oct. 16, 2018 from corresponding International Patent Application No. PCT/EP2018/064237.

*Primary Examiner* — John M Zaleskas

(57) ABSTRACT

In a method, dynamic pressure oscillations in the intake tract or outlet tract of a respective internal combustion engine are measured during normal operation, and from these measured oscillations, a corresponding pressure oscillation signal is generated. A crankshaft phase angle signal is determined at the same time. From the pressure oscillation signal, an actual value of at least one characteristic of at least one selected signal frequency of the measured pressure oscillations in relation to the crankshaft phase angle signal is determined, and the current trimming of the intake tract is determined on the basis of the determined actual value, taking into consideration reference values of the corresponding characteristic of the respectively identical signal frequency for different trimmings of the intake tract.

18 Claims, 5 Drawing Sheets

(51) Int. Cl.

| | |
|---|---|
| *F02D 41/28* | (2006.01) |
| *F02M 35/10* | (2006.01) |
| *F02D 41/14* | (2006.01) |
| *F02D 41/22* | (2006.01) |

(52) U.S. Cl.
CPC ..... *F02D 41/1448* (2013.01); *F02D 41/22* (2013.01); *F02D 2041/001* (2013.01); *F02D 2041/288* (2013.01); *F02D 2200/021* (2013.01); *F02D 2200/0406* (2013.01); *F02D 2200/0414* (2013.01); *F02D 2200/0612* (2013.01); *F02D 2200/101* (2013.01); *F02M 35/10* (2013.01); *F02M 35/10301* (2013.01)

(58) Field of Classification Search
CPC ..... F02D 2041/0015; F02D 2041/288; F02D 2200/0406; F02D 2200/101; F02M 35/10; F02M 35/10301; F02B 27/005; F02B 27/02; F02B 27/0215; F02B 27/0221; F02B 27/0231; F02B 27/0236; F02B 27/0294
See application file for complete search history.

(56) References Cited

U.S. PATENT DOCUMENTS

| | | | | |
|---|---|---|---|---|
| 4,846,117 | A * | 7/1989 | Hitomi | F02B 27/02 123/184.31 |
| 4,932,378 | A * | 6/1990 | Hitomi | F02B 27/02 123/432 |
| 6,293,235 | B1 * | 9/2001 | Cobb, Jr. | F02M 26/01 123/73 B |
| 6,546,789 | B1 * | 4/2003 | Wild | F02B 27/02 73/114.32 |
| 7,543,484 | B2 | 6/2009 | Kasner | |
| 2006/0096581 | A1 * | 5/2006 | Pauli | F02B 27/0273 123/480 |
| 2006/0184311 | A1 * | 8/2006 | Schulte | F02D 41/1498 701/114 |
| 2008/0120018 | A1 * | 5/2008 | Wiles | F01L 1/022 701/111 |
| 2008/0149061 | A1 * | 6/2008 | Rauner | F02B 27/0215 123/184.55 |
| 2008/0196692 | A1 * | 8/2008 | Akuzawa | F02B 27/0294 123/402 |
| 2008/0229817 | A1 * | 9/2008 | Hartmann | F02D 41/221 73/114.79 |
| 2008/0236267 | A1 * | 10/2008 | Hartmann | F02D 41/221 73/114.37 |
| 2009/0132144 | A1 * | 5/2009 | Shinozaki | F02D 35/023 701/102 |
| 2009/0157280 | A1 * | 6/2009 | Burkhardt | F02D 41/18 701/103 |
| 2010/0175463 | A1 * | 7/2010 | Doering | F02D 41/221 73/114.37 |
| 2011/0137509 | A1 * | 6/2011 | Sarac | F02D 13/02 701/31.4 |
| 2017/0198649 | A1 * | 7/2017 | Kainz | F02D 41/2432 |
| 2017/0226970 | A1 * | 8/2017 | Ford | F02M 35/10118 |
| 2018/0355815 | A1 * | 12/2018 | Braun | F02D 41/0002 |
| 2019/0003413 | A1 * | 1/2019 | Braun | F02D 41/34 |
| 2020/0040829 | A1 * | 2/2020 | Braun | F02D 41/009 |
| 2020/0040830 | A1 * | 2/2020 | Braun | F01L 1/34 |
| 2020/0063674 | A1 * | 2/2020 | Braun | F02D 41/2432 |
| 2020/0200113 | A1 * | 6/2020 | Braun | F01N 11/00 |
| 2020/0284212 | A1 * | 9/2020 | Braun | F02D 35/023 |

FOREIGN PATENT DOCUMENTS

| | | | | |
|---|---|---|---|---|
| DE | 10302806 | A1 | 12/2004 | |
| DE | 10346734 | B3 | 4/2005 | |
| DE | 102005031393 | A1 | 2/2006 | |
| DE | 102005007057 | A1 | 8/2006 | |
| DE | 102008008209 | A1 * | 8/2009 | F02B 27/0215 |
| DE | 102010034133 | A1 | 2/2012 | |
| DE | 102015209665 | A1 | 12/2015 | |
| DE | 102014227048 | A1 | 6/2016 | |
| DE | 102015226138 | B3 | 12/2016 | |
| DE | 102015222408 | B3 | 3/2017 | |
| DE | 102015222408 | B3 * | 3/2017 | F02D 41/2432 |
| EP | 1770258 | A1 * | 4/2007 | F02B 27/021 |
| JP | 60184924 | A * | 9/1985 | F02B 27/0215 |
| JP | 61076718 | A * | 4/1986 | F02B 27/0215 |
| JP | 05321674 | A | 12/1993 | |
| JP | H09236514 | A | 9/1997 | |
| JP | 11082035 | A * | 3/1999 | F02D 9/02 |
| JP | 2011064178 | A | 3/2011 | |
| JP | 2011064178 | A1 | 3/2011 | |

* cited by examiner

METHOD FOR DETERMINING THE CURRENT TRIMMING OF THE INTAKE TRACT OF AN INTERNAL COMBUSTION ENGINE DURING OPERATION

CROSS REFERENCE TO RELATED APPLICATIONS

This application claims the benefit of PCT Application PCT/EP2018/064237, filed May 30, 2018, which claims priority to German Application DE 10 2017 209 386.2, filed Jun. 2, 2017. The disclosures of the above applications are incorporated herein by reference.

FIELD OF INVENTION

The present invention relates to a method for determining the current trimming of the intake tract of an internal combustion engine from a pressure oscillation signal measured in the inlet tract or in the exhaust gas tract during the operation of the internal combustion engine.

BACKGROUND

Reciprocating-piston internal combustion engines, which will in this context and hereinafter also be referred to in shortened form merely as internal combustion engines, have one or more cylinders in which in each case one reciprocating piston is arranged. To illustrate the principle of a reciprocating-piston internal combustion engine, reference will be made below to FIG. 1, which illustrates by way of example a cylinder of an internal combustion engine, which is possibly also a multi-cylinder internal combustion engine, together with the most important functional units.

The respective reciprocating piston 6 is arranged in linearly movable fashion in the respective cylinder 2 and, together with the cylinder 2, encloses a combustion chamber 3. The respective reciprocating piston 6 is connected by means of a so-called connecting rod 7 to a respective crankpin 8 of a crankshaft 9, wherein the crankpin 8 is arranged eccentrically with respect to the crankshaft axis of rotation 9*a*. As a result of the combustion of a fuel-air mixture in the combustion chamber 3, the reciprocating piston 6 is driven linearly "downward". The translational stroke movement of the reciprocating piston 6 is transmitted by means of the connecting rod 7 and crankpin 8 to the crankshaft 9 and is converted into a rotational movement of the crankshaft 9, which causes the reciprocating piston 6, owing to its inertia, after it passes through a bottom dead center in the cylinder 2, to be moved "upward" again in the opposite direction as far as a top dead center. To permit continuous operation of the internal combustion engine 1, during a so-called working cycle of a cylinder 2, it is necessary firstly for the combustion chamber 3 to be filled with the fuel-air mixture via the so-called inlet tract, for the fuel-air mixture to be compressed in the combustion chamber 3 and to then be ignited (by means of an ignition plug in the case of a gasoline internal combustion engine and by auto-ignition in the case of a diesel internal combustion engine) and burned in order to drive the reciprocating piston 6, and finally for the exhaust gas that remains after combustion to be discharged from the combustion chamber 3 into the exhaust gas tract. Continuous repetition of this sequence results in continuous operation of the internal combustion engine 1, with work being output in a manner proportional to the combustion energy.

Depending on the engine concept, a working cycle of the cylinder 2 is divided into two strokes distributed over one crankshaft rotation (360°) (two-stroke engine) or into four strokes distributed over two crankshaft rotations (720°) (four-stroke engine).

To date, the four-stroke engine has become established as a drive for motor vehicles. In an intake stroke, with a downward movement of the reciprocating piston 6, fuel-air mixture 21 (in the case of intake pipe injection by means of injection valve 5*a*, illustrated as an alternative in FIG. 1 by means of dashed lines) or else only fresh air (in the case of fuel direct injection by means of injection valve 5) is introduced from the inlet tract 20 into the combustion chamber 3. During the following compression stroke, with an upward movement of the reciprocating piston 6, the fuel-air mixture or the fresh air is compressed in the combustion chamber 3, and if appropriate fuel is separately injected by means of an injection valve 5. During the following working stroke, the fuel-air mixture, for example in the case of the gasoline internal combustion engine, is ignited by means of an ignition plug 4, burns and expands, outputting work, with a downward movement of the reciprocating piston 6. Finally, in an exhaust stroke, with another upward movement of the reciprocating piston 6, the remaining exhaust gas 31 is discharged out of the combustion chamber 3 into the exhaust-gas tract 30.

The delimitation of the combustion chamber 3 with respect to the inlet tract 20 or exhaust-gas tract 30 of the internal combustion engine 1 is realized generally, and in particular in the example taken as a basis here, by means of inlet valves 22 and outlet valves 32. In the current prior art, said valves are actuated by means of at least one camshaft. The example shown has an inlet camshaft 23 for actuating the inlet valves 22 and has an outlet camshaft 33 for actuating the outlet valves 32. There are normally yet further mechanical components (not illustrated here) for force transmission provided between the valves and the respective camshaft, which components may also include a valve play compensation means (e.g. bucket tappet, rocker lever, finger-type rocker, tappet rod, hydraulic tappet etc.).

The inlet camshaft 23 and the outlet camshaft 33 are driven by means of the internal combustion engine 1 itself. For this purpose, the inlet camshaft 23 and the outlet camshaft 33 are coupled in each case by means of suitable inlet camshaft control adapters 24 and outlet camshaft control adapters 34, such as for example toothed gears, sprockets or belt pulleys using a control mechanism 40, which has for example a toothed gear mechanism, a control chain or a toothed control belt, in a predefined position with respect to one another and with respect to the crankshaft 9 by means of a corresponding crankshaft control adapter 10, which is correspondingly embodied as a toothed gear, sprocket or belt pulley, to the crankshaft 9. By means of this connection, the rotational position of the inlet camshaft 23 and of the outlet camshaft 33 in relation to the rotational position of the crankshaft 9 is, in principle, defined. By way of example, FIG. 1 illustrates the coupling between inlet camshaft 23 and the outlet camshaft 33 and the crankshaft 9 by means of belt pulleys and a toothed control belt.

The rotational angle covered by the crankshaft during one working cycle will hereinafter be referred to as working phase or simply as phase. A rotational angle covered by the crankshaft within one working phase is accordingly referred to as phase angle. The respectively current crankshaft phase angle of the crankshaft 9 can be detected continuously by means of a position encoder 43 connected to the crankshaft 9, or to the crankshaft control adapter 10, and an associated crankshaft position sensor 41. Here, the position encoder 43 may be formed for example as a toothed gear with a multiplicity of teeth arranged so as to be distributed equidistantly over the circumference, wherein the number of individual teeth determines the resolution of the crankshaft phase angle signal.

It is likewise additionally possible, if appropriate, for the present phase angles of the inlet camshaft 23 and of the outlet camshaft 33 to be detected continuously by means of corresponding position encoders 43 and associated camshaft position sensors 42.

Since, owing to the predefined mechanical coupling, the respective crankpin 8, and with the latter the reciprocating piston 6, the inlet camshaft 23, and with the latter the respective inlet valve 22, and the outlet camshaft 33, and with the latter the respective outlet valve 32, move in a predefined relationship with respect to one another and in a manner dependent on the crankshaft rotation, said functional components run through the respective working phase synchronously with respect to the crankshaft. The respective rotational positions and stroke positions of reciprocating piston 6, inlet valves 22 and outlet valves 32 can thus, taking into consideration the respective transmission ratios, be set in relation to the crankshaft phase angle of the crankshaft 9 predefined by the crankshaft position sensor 41. In an ideal internal combustion engine, it is thus possible for every particular crankshaft phase angle to be assigned a particular crankpin angle, a particular piston stroke, a particular inlet camshaft angle and thus a particular inlet valve stroke and also a particular outlet camshaft angle and thus a particular outlet camshaft stroke. That is to say, all of the stated components are, or move, in phase with the rotating crankshaft 9.

Also symbolically illustrated is an electronic, programmable engine control unit 50 (CPU) for controlling the engine functions, which engine control unit 50 is equipped with signal inputs 51 for receiving the various sensor signals and with signal and power outputs 52 for actuating corresponding positioning units and actuators and with an electronic processing unit 53 and an assigned electronic memory unit 54.

Owing to the so-called exhaust and refill process of the internal combustion engine, i.e. the induction of fresh air 21 or fuel-air mixture from the intake tract 20, also referred to as the inlet tract, into the combustion chamber 3 and the expulsion of the exhaust gas 31 into the outlet tract 30, also referred to as the exhaust gas tract, which takes place after combustion and depends on the stroke motion of the reciprocating piston 6 and the opening and closing of the inlet valves 22 and outlet valves 32, pressure oscillations are generated in the intake air or the air-fuel mixture in the intake tract and in the exhaust gas in the outlet tract, and these likewise occur in phase with the rotation of the crankshaft 9 and can thus be set in relation to the crankshaft phase angle.

In order to optimize the operation of an internal combustion engine, it has long been the practice in the prior art to detect continuously determined actual operating parameters by means of sensors and, in the event of deviations from setpoint operation, to adapt or correct the influencing control parameters by means of the electronic engine control unit. The focus here has hitherto been on fuel injection quantities, injection and ignition points, valve timings, boost pressure, air mass supplied, exhaust gas composition (lambda values), exhaust gas temperature etc.

In the very recent past, the requirements on exhaust gas composition and exhaust gas quantity for internal combustion engines, which are becoming ever stricter throughout the world, have led to a development trend for "downsizing", wherein cubic capacities have been reduced and power has been increased by means of alternative measures for improved filling of the combustion chambers with air-fuel mixture and the increased combustion energy resulting from this. This can be achieved by turbocharging or electric compressor charging, for example.

Another possibility of achieving a similar effect consists in optimizing the design of the intake tract or using a so-called variable intake tract. The design can involve so-called resonators, which generate resonant vibrations in certain engine speed ranges, and the variability of the intake tract can include various design measures, e.g. a switchable intake manifold or variable intake manifold or, alternatively, so-called swirl flaps in the intake tract of the internal combustion engine.

The effect of a resonator and of a switchable intake manifold or variable intake manifold is based on the principle of the gas oscillations of the air column in the intake tract which are induced by the exhaust and refill process and have already been mentioned above. Thus, a reduced pressure wave forms in the inlet tract, for example, this being reflected at the end of the intake manifold and returning as an excess pressure wave. It is thereby possible to prevent the air that has already been drawn into the combustion chamber or the air-fuel mixture from flowing back into the intake tract, or even to achieve a pressure charging effect by means of the returning excess pressure wave if the returning excess pressure wave strikes an open inlet valve. In this context, reference is made to a resonance effect in which a certain rhythm arises between the timings of the inlet valves, the intake strokes and the gas oscillations, leading to improved cylinder charging and thus to higher power. This effect can be achieved through the arrangement of appropriately designed resonators in the intake tract.

Since these oscillation processes in the air column always take place at the speed of sound, but the opening times of the inlet valves depend on the current speed of the internal combustion engine, i.e. the rotational speed of the crankshaft, this effect occurs only in certain engine speed ranges, for which reason the aim is to achieve a design for the resonators or intake manifold lengths which generates increased power, especially a higher torque, at certain mean engine speeds.

To enable the effect to be exploited at different speeds of the internal combustion engine or over a wider engine speed range, the length of the intake manifold can be varied as a function of the engine speed, for example. In this context, so-called switchable intake manifolds, in which a switch can be made between two or even more intake manifold lengths, are known from the prior art. However, intake manifolds with an infinitely variable intake manifold length are also known. Such an arrangement is illustrated schematically in simplified form in FIGS. 2*a* and 2*b*. FIGS. 2*a* and 2*b* each show the same internal combustion engine as per FIG. 1, which is supplemented in the region of the intake tract 20 by a variably adjustable intake manifold 60 and an air filter 62. Here, the intake manifold adjustment 61 is symbolized by means of an arrow. FIG. 2*a* shows a setting of the intake manifold with a shortened intake manifold length, e.g. for high speeds of the internal combustion engine. FIG. 2*b* shows the same arrangement as FIG. 2*a* but with a setting of the intake manifold with a maximum intake manifold length, e.g. for low engine speeds. Here, the length of the intake pipe can be modified by moving the intake manifold elbow axially by means of an actuating device (not illustrated here)

and thus adapted to the respective operating point, e.g. as a function of the speed, of the internal combustion engine.

Further possibilities for influencing the charging behavior of the combustion chambers and mixture preparation comprise installing so-called swirl flaps, which are used especially with internal combustion engines that have two inlet valves per cylinder, in order to ensure better swirling when the swirl flaps are closed, i.e. mixing of the air-fuel mixture at low engine speeds and to ensure better charging of the combustion chambers when the swirl flaps are open. The free intake cross section of the intake manifold is changed by the actuation of the swirl flaps.

The abovementioned measures in the intake tract, particularly the arrangement and design of resonators, of variable intake manifold lengths and of the intake manifold cross sections that can be varied by means of swirl flaps are considered jointly below under the term "trimming of the intake tract".

Here too, as already described in connection with the abovementioned operating parameters of the internal combustion engine, it is essential that the real actual value of the set trimming of the intake tract is compared with the specified setpoint and that a corrective intervention can be made if necessary. For this purpose, the current trimming of the intake tract must be reliably detected. In the case of variable trimming, for example, this has hitherto only been possible indirectly by detecting the actuating travel of an actuator. In this case, there remain uncertainties since any tolerances or deviations that may be present in the actuating system are not detected.

Even in the case of internal combustion engines with essentially constant trimming of the intake tract, however, determination of the current trimming of the intake tract during continuous operation is desirable, e.g. for early detection of wear phenomena or for so-called onboard diagnosis (OBD), as well as for checking the plausibility of further operating parameters or for detecting external mechanical interventions into the mechanism of the internal combustion engine, e.g. when the intake tract is modified in the course of tuning measures.

SUMMARY

An aspect is therefore to permit, as far as possible without additional sensor installation and outlay in terms of apparatus, as exact as possible a determination of the current trimming of the intake tract during presently ongoing operation, in order to be able to make appropriate adaptations to the operating parameters to correct the trimming of the intake tract or even to optimize ongoing operation.

The aspect is achieved by an embodiment of the method according to the invention for determining the current trimming of the intake tract of an internal combustion engine during operation. Developments and design variants of the method according to the invention are the subject matter of the discussion below.

The aspect, as indicated below, is based on the insight that there is a unique relationship between the trimming of the intake tract and the pressure oscillations in the intake tract. However, there is also a unique relationship between the pressure oscillations in the outlet tract and the trimming of the intake tract, e.g. by way of the modified exhaust and refill behavior and any time overlaps that may exist between the opening times of the inlet valves and the outlet valves. It is thus possible to use both the pressure oscillations in the intake tract and the pressure oscillations in the outlet tract.

According to one embodiment of the method according to the invention, the dynamic pressure oscillations, assignable to one cylinder of the internal combustion engine, in the intake tract or in the outlet tract of the respective internal combustion engine are measured at a defined operating point during normal operation, and from these, a corresponding pressure oscillation signal is generated. At the same time, that is in association in terms of time, a crankshaft phase angle signal of the internal combustion engine is determined, as it were as a reference signal for the pressure oscillation signal.

One possible operating point would for example be idle operation at a predefined rotational speed. Care should advantageously be taken here to ensure that other influences on the pressure oscillation signal are as far as possible excluded or at least minimized. Normal operation characterizes the intended operation of the internal combustion engine, for example in a motor vehicle, wherein the internal combustion engine is an example of a series of internal combustion engines of identical design. Further customary terms for an internal combustion engine of said type would be series internal combustion engine or field internal combustion engine.

The measured pressure oscillations in the intake tract or in the outlet tract are pressure oscillations in the intake air or the induced air-fuel mixture in the intake tract or are pressure oscillations in the exhaust gas in the outlet tract.

From the pressure oscillation signal, using discrete Fourier transformation, at least one actual value of at least one characteristic of at least one selected signal frequency of the measured pressure oscillations in relation to the crankshaft phase angle signal is then determined.

In the further course of the method, the current trimming of the intake tract of the internal combustion engine is then determined on the basis of the at least one determined actual value for the respective characteristic, taking into consideration reference values of the respectively corresponding characteristic of the respectively identical signal frequency for different trimmings of the intake tract.

For the analysis of the pressure oscillation signal recorded in the intake tract or in the outlet tract of the internal combustion engine, said pressure oscillation signal is subjected to a discrete Fourier transformation (DFT). For this purpose, an algorithm known as a fast Fourier transformation (FFT) may be used for the efficient calculation of the DFT. By means of DFT, the pressure oscillation signal is now broken down into individual signal frequencies which can thereafter be separately analyzed in simplified fashion with regard to their amplitude and the phase position. In the present case, it has been found that both the phase position and the amplitude of selected signal frequencies of the pressure oscillation signal are dependent on the trimming of the intake tract of the respective internal combustion engine. For this purpose, it is advantageous for consideration to be given only to those signal frequencies which correspond to the intake frequency, as base frequency or so-called 1st harmonic, of the internal combustion engine or to a multiple of the intake frequency, that is to say the 2nd to n-th harmonic, wherein the intake frequency in turn has a unique relationship with the speed and thus with the combustion cycle or phase cycle of the internal combustion engine. Then, for at least one selected signal frequency, taking into consideration the crankshaft phase angle signal detected in parallel, at least one actual value of the phase position, the amplitude or for both, as a characteristic of said selected signal frequencies is determined in relation to the crankshaft phase angle.

In order now to determine the current trimming of the intake tract from the actual value, thus determined, of the characteristic of the selected signal frequency of the pressure oscillation signal, the value of the determined characteristic is compared with so-called reference values of the respectively corresponding characteristic of the respectively identical signal frequency for different trimmings of the intake tract of the internal combustion engine. The corresponding trimmings of the intake tract are uniquely assigned to these reference values of the respective characteristic. This enables the associated trimming of the intake tract to be inferred by way of the reference value coinciding with the determined actual value.

The advantages of the method according to the invention reside in the fact that the current trimming of the intake tract of the internal combustion engine can be determined exclusively on the basis of a respective pressure signal, which can be determined by means of sensors that are present in the system in any case, and can be analyzed or processed by means of an electronic processing unit, present in any case, for engine control, and thus the current trimming of the intake tract of the internal combustion engine can be determined without additional outlay in terms of apparatus. When required, it is then possible on this basis to correctively modify the control parameters of the internal combustion engine and, in particular, the trimming setting of the intake tract in such a way that a setpoint is achieved or optimum operation at the respective operating point is ensured.

BRIEF DESCRIPTION OF THE DRAWINGS

To explain the functioning of an internal combustion engine underlying the invention and the relationships between the trimming of the intake tract and the characteristics, phase position and amplitude of the pressure oscillation signal measured in the intake tract or outlet tract for certain selected signal frequencies, and to describe particularly advantageous exemplary embodiments, details or developments of the subject matter of the invention, as per the dependent claims, reference is made below to the figures, although there is no intention to restrict the subject matter of the invention to these examples. In the drawings:

DETAILED DESCRIPTION

Items of identical function and designation are denoted by the same reference signs throughout the figures.

Figure 1:
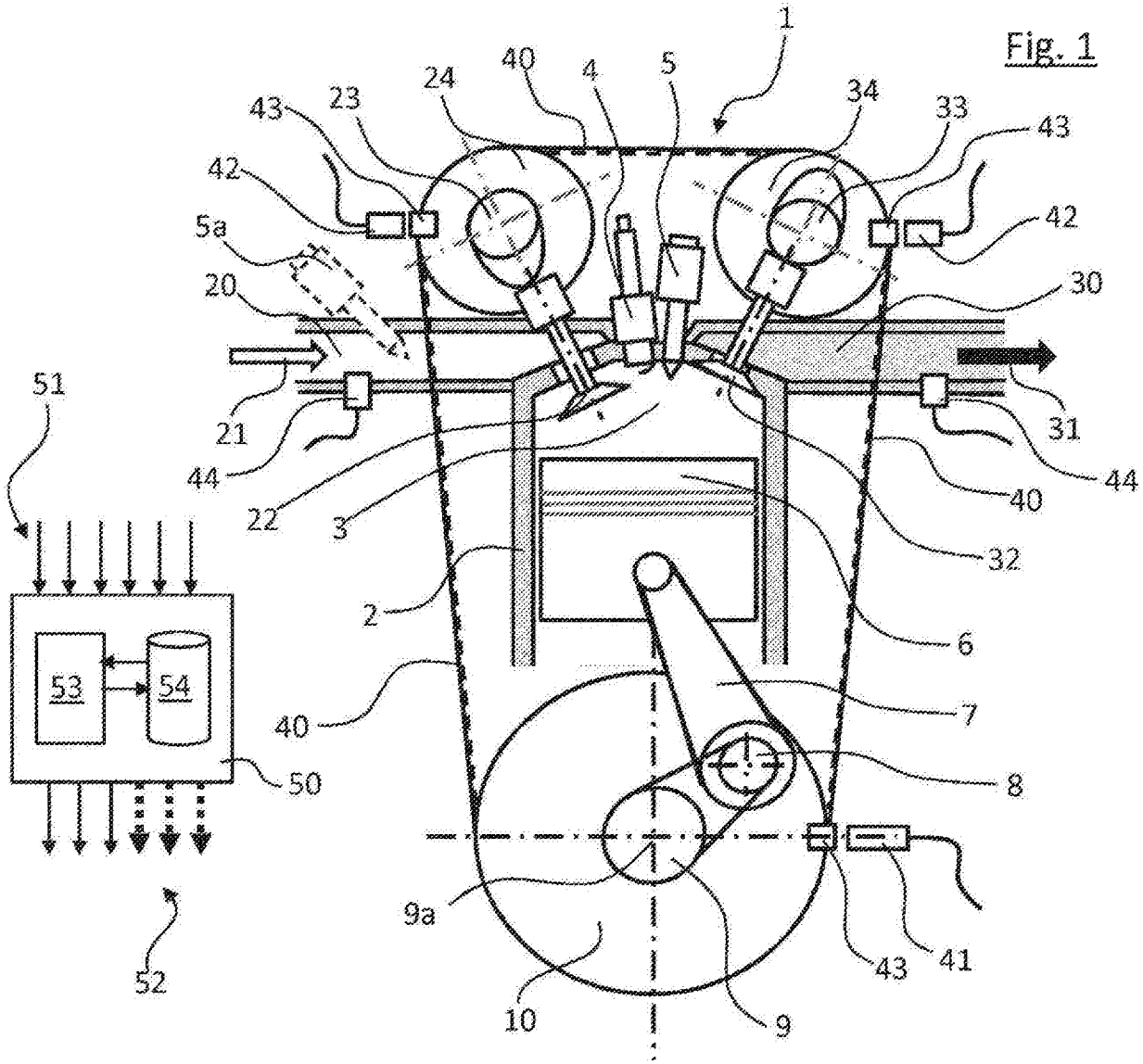
FIG. 1 is a simplified illustration of a reciprocating-piston internal combustion engine, referred to here in shortened form as internal combustion engine, with pertinent functional components.
Figure 2A:
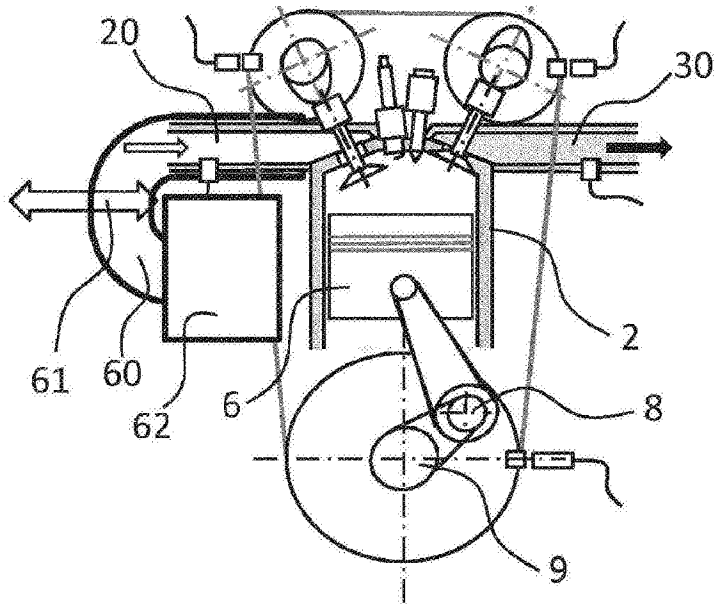
FIGS. 2*a* and 2*b* are two further-simplified illustrations of the internal combustion engine according to FIG. 1 intended to illustrate the trimming of the intake tract by means of the intake manifold length, wherein the intake manifold length is shown in a shortened setting in FIG. 2*a*, and the intake manifold length is shown in the maximum setting in FIG. 2*b;*
Figure 2B:
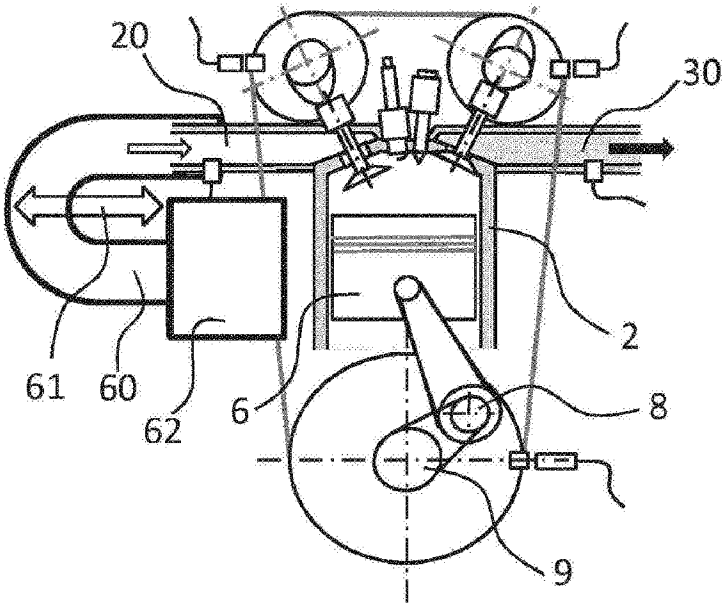

FIGS. 1 and 2 have already been thoroughly explored in the above description of the principle of operation of an internal combustion engine and for the explanation of the trimming of the intake tract.

In the implementation of the method according to the invention, it is assumed, as already mentioned above, that the relationship or the dependency of the stated variables between or on one another is uniquely known. The relationships are explained below for the pressure oscillation signal measured in the intake tract, but are similarly applicable to the pressure oscillation signal in the outlet tract too.

Figure 3:
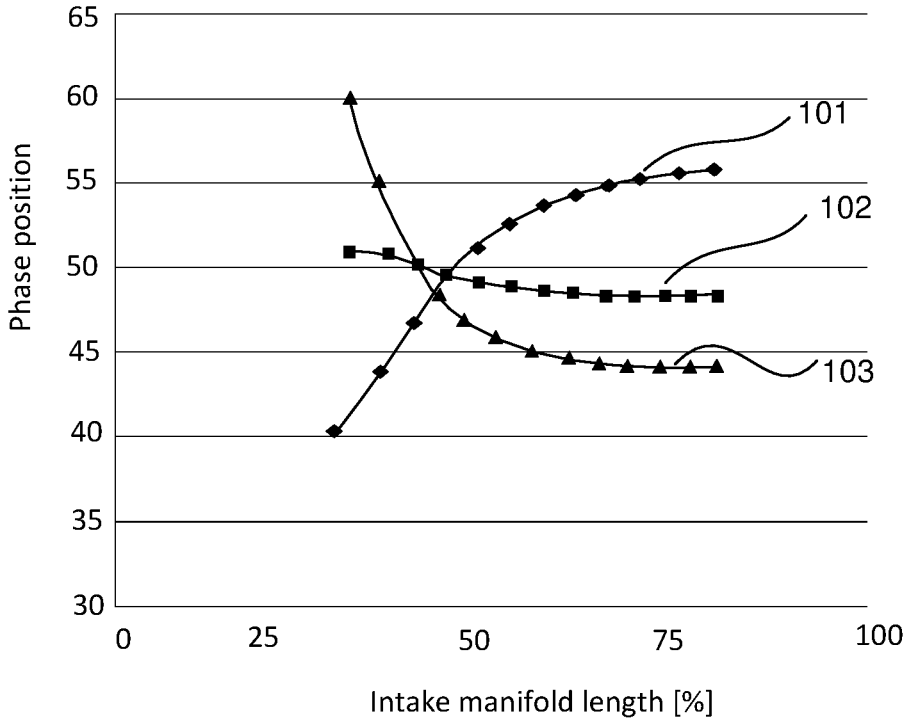
FIG. 3 shows a diagram intended to illustrate an example of the dependency between the phase position of the pressure oscillation signal and the intake manifold length at various signal frequencies.

FIG. 3 shows this relationship by way of example with reference to the characteristic comprising the phrase position of the pressure oscillation signal in the intake tract as a function of the trimming of the intake tract, in this case, by way of example, with reference to a variable intake manifold length in %, at various signal frequencies. It has been found here that it is quite possible for different profiles of the values of the phase position to be obtained at different signal frequencies as the intake manifold length increases. Interpolation between the individual measurement points results in each case in a continuous curve, wherein curve 101 has a rising profile with an increasing intake manifold length at the intake frequency, curve 102 has an initially falling and then almost constant profile at twice the intake frequency, and curve 103 has a falling profile with an increasing intake manifold length at three times the intake frequency. In this case, said curves 101, 102 and 103 intersect approximately in the region of 45% of the intake manifold length.

Figure 4:
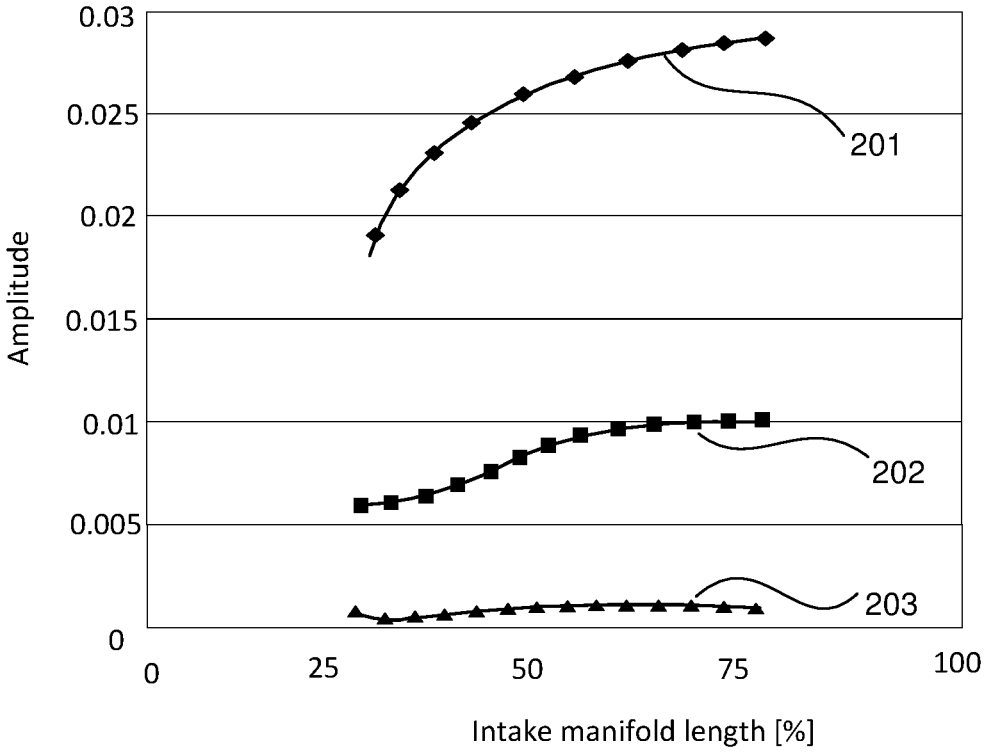
FIG. 4 shows a diagram intended to illustrate an example of the dependency between the amplitude of the pressure oscillation signal and the intake manifold length at various signal frequencies.

FIG. 4 shows the relationship, likewise by way of example, with reference to the characteristic comprising the amplitude of the pressure oscillation signal in the intake tract as a function of the variable intake manifold length in % as a parameter of the trimming of the intake tract, once again at various signal frequencies. Here too, interpolation between the individual measurement points results in each case in a continuous curve, wherein curve 201 has a rising profile with an increasing intake manifold length at the intake frequency, curve 202 has a profile which rises with a shallower gradient than curve 201 at twice the intake frequency, and curve 203 has an almost constant profile with an increasing intake manifold length at three times the intake frequency.

In the case of both characteristics, namely the phase position and the amplitude, it is found in this example that the accuracy and explanatory power of the method according to the invention may depend on the selection of an advantageous signal frequency for the determination of the trimming of the intake tract.

In one embodiment of the method according to the invention, the reference values of the respective characteristic as a function of the trimming of the intake tract are made available in at least one respective reference value characteristic map. A reference value characteristic map of this kind contains, for example, reference values for the phase position as a function of values for the trimming of the intake tract for different signal frequencies, as illustrated in FIG. 3, or reference values for the amplitude as a function of values for the trimming of the intake tract for different signal frequencies, as illustrated in FIG. 4. Here, a plurality of such characteristic maps can in each case be made available for different operating points of the internal combustion engine. Thus, a corresponding, more comprehensive characteristic map may, for example, include corresponding reference value curves for different operating points of the internal combustion engine and different signal frequencies.

Figure 5:
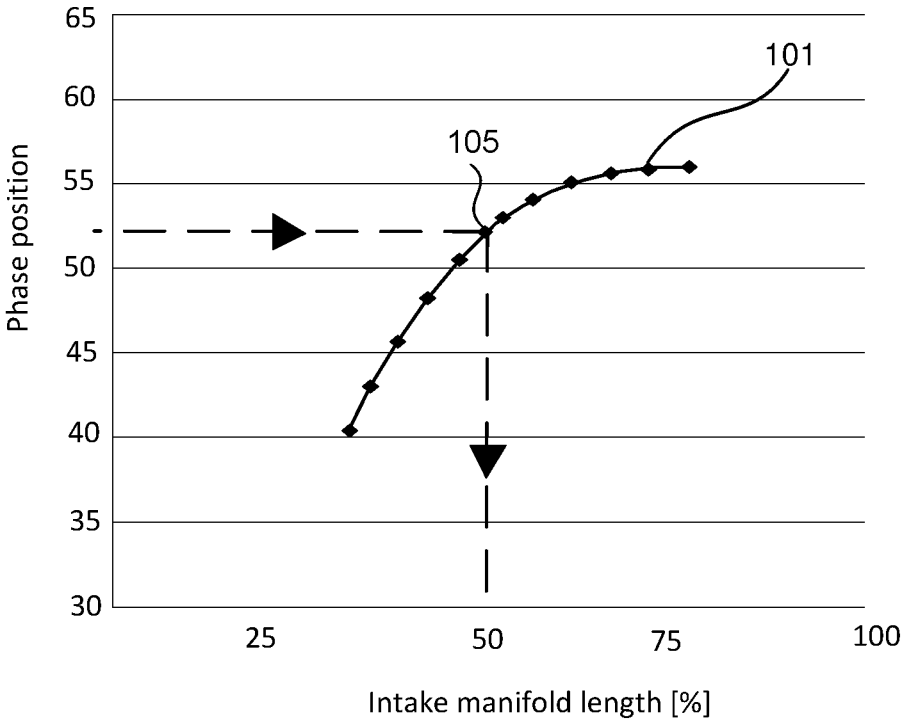
FIG. 5 shows a diagram intended to illustrate reference phase positions of a signal frequency as a function of the trimming of the intake tract and the determination of a specific value of the trimming of the intake tract, based on a currently determined value of the phase position of a pressure oscillation signal.

The determination of the current trimming of the intake tract of the internal combustion engine can then be performed in a simple manner, as illustrated in FIG. 5 by the example of the phase position, in such a way that, proceeding from the determined actual value of a characteristic of the pressure oscillation signal, in this case a value of about 52.5 of the phase position, for a selected signal frequency, in this case the first harmonic 101, i.e. intake frequency, the associated point 105 on the reference curve of the first harmonic 101 is determined during normal operation of the internal combustion engine, and proceeding from this in turn, the associated trimming of the intake tract, in this case about 50% of the maximum intake manifold length, is determined, as visually illustrated on the basis of the dashed line in FIG. 5. Thus, the current trimming of the intake tract can be determined during operation in a particularly simple manner and with little computational effort.

As an option, at least one respective algebraic model function, characterizing the corresponding reference curve, for the mathematical determination of the respective reference value of the respectively corresponding characteristic is made available instead or as a supplementary measure, said model representing the relationship between the characteristic and the trimming of the intake tract. The determined actual value of the respective characteristic is specified, and the trimming of the intake tract is then calculated in real time. The advantage of this alternative lies in the fact that, overall, less memory capacity has to be made available.

The execution of the method according to the invention, i.e. the determination of the actual value of the respective characteristic of the selected signal frequency and the determination of the current trimming of the intake tract of the internal combustion engine, is advantageously performed with the aid of an electronic processing unit assigned to the internal combustion engine, which is preferably part of an engine control unit. Here, the respective reference value characteristic map and/or the respective algebraic model function are/is stored in at least one memory area assigned to the electronic processing unit, said area preferably likewise being part of the engine control unit. This is illustrated in simplified form with the aid of the block diagram in FIG. 6. An engine control unit 50 containing the electronic processing unit 53 is illustrated symbolically here by the frame in dashed lines, which contains the individual steps/blocks of one embodiment of the method according to the invention and the electronic memory area 54.

One particularly advantageous possibility for carrying out the method according to the invention involves the use of an electronic processing unit 53 assigned to the internal combustion engine, which is, for example, part of the central engine control unit 50, also referred to as a central processing unit or CPU, which is used to control the internal combustion engine 1. In this case, the reference value characteristic maps or the algebraic model functions can be stored in at least one electronic memory area 54 of the CPU 50.

In this way, the method according to the invention can be carried out automatically, very quickly and repeatedly during the operation of the internal combustion engine, and an adaptation or correction of further control variables or control routines for controlling the internal combustion engine as a function of the determined trimming of the intake tract can be performed directly by the engine control unit.

This firstly has the advantage that no separate electronic processing unit is required, and there are thus also no additional interfaces, which are possibly susceptible to failure, between multiple processing units. Secondly, the method according to the invention can thus be made an integral constituent part of the control routines of the internal combustion engine, whereby a fast adaptation of the control variables or control routines for the internal combustion engine to the current trimming of the intake tract is possible.

As already indicated above, it is assumed that the reference values of the respective characteristic for different trimmings of the intake tract are available for the implementation of the method.

For this purpose, in an enhancement of the method according to the invention, the reference values of the respective characteristic for at least one selected signal frequency are determined in advance on a reference internal combustion engine as a function of different trimmings of the intake tract. This is illustrated symbolically in the block diagram in FIG. 6 by the blocks denoted by B10 and B11, wherein block B10 indicates the measurement of a reference internal combustion engine (Vmssg_Refmot) and block B11 symbolizes the collation of the measured reference values of the respective characteristic at selected signal frequencies to form reference value characteristic maps (RWK_DSC_SF_1 . . . X). Here, the reference internal combustion engine is an internal combustion engine of identical design to the corresponding internal combustion engine series, and in which, in particular, it is ensured that no behavior-influencing structural tolerance deviations are present. This is intended to ensure that the relationship between the respective characteristic of the pressure oscillation signal and the trimming of the intake tract can be determined as accurately as possible and without the influence of further disturbance factors.

The determination of corresponding reference values is possible by means of the reference internal combustion engine at different operating points and with presetting or variation of further operating parameters such as the temperature of the intake medium, the coolant temperature or the engine speed. The reference value characteristic maps thus generated, see FIGS. 3 and 4 for example, can then advantageously be made available in all internal combustion engines of identical design in the series, in particular stored in an electronic memory area 54 of an electronic engine control unit 50 assignable to the internal combustion engine.

As a continuation of the abovementioned prior determination of the reference values of the respective characteristic of the selected signal frequencies, it is possible, from the determined reference values of the selected signal frequency and the associated trimmings of the intake tract, to derive a respective algebraic model function which represents at least the relationship between the respective characteristic of the selected signal frequency and the trimming of the intake tract. This is symbolized in the block diagram in FIG. 6 by the block denoted by B12. Here, it is optionally also possible for the abovementioned further parameters to also be incorporated. An algebraic model function (Rf(DSC_SF_1 . . . X) is thus generated with which, with presetting of the phase position and possible incorporation of the abovementioned variables, the value of the respective trimming of the intake tract can be calculated in real time.

The model function can then advantageously be made available in all internal combustion engines of identical design in the series, in particular stored in an electronic memory area 54 of an electronic engine control unit 50 assignable to the internal combustion engine. The advantages lie in the fact that the model function requires less memory space than comprehensive reference value characteristic maps.

In an implementation example, the determination in advance of the reference values of the respective characteristic of the selected signal frequency can be performed by the measurement of a reference internal combustion engine (Vmssg_Refmot) at at least one defined operating point while specifying certain reference trimmings of the intake tract. This is symbolized in the block diagram in FIG. 7 by the block denoted by B10. Here, for the determination of the reference values of the respective characteristic of the selected signal frequency, the dynamic pressure oscillations, assignable to one cylinder of the reference internal combustion engine, in the intake tract or in the outlet tract are measured during operation, and a corresponding pressure oscillation signal is generated.

At the same time as, i.e. in association in terms of time with, the measurement of the dynamic pressure oscillations, a crankshaft phase angle signal is determined. Subsequently, reference values of the respective characteristic of the selected signal frequency of the measured pressure oscillations in relation to the crankshaft phase angle signal are determined from the pressure oscillation signal by means of discrete Fourier transformation.

The determined reference values are then stored as a function of the associated trimming of the intake tract in reference value characteristic maps (RWK_DSC_SF_1 . . . X). This allows reliable determination of the dependence between the respective characteristic of the pressure oscillation signal of the selected signal frequency and the trimming of the intake tract.

In all the abovementioned embodiments and developments of the method according to the invention, a phase position or an amplitude or, alternatively, a phase position and an amplitude of at least one selected signal frequency can be used as the at least one characteristic of the measured pressure oscillations. The phase position and the amplitude are the essential basic characteristics which can be determined by means of discrete Fourier transformation in relation to individual selected signal frequencies. In the simplest case, precisely one actual value, e.g. of the phase position at a selected signal frequency, e.g. of the 2nd harmonic, is determined at a particular operating point of the internal combustion engine, and the associated value for the trimming of the intake tract is determined by assigning this value to the corresponding reference value of the phase position in the stored reference value characteristic map, at the same signal frequency.

However, it is also possible for a plurality of actual values, e.g. for the phase position and the amplitude and at different signal frequencies, to be determined and combined in order to determine the trimming of the intake tract, e.g. by averaging. In this way, it is advantageously possible to increase the accuracy of the determined value for the trimming of the intake tract.

According to another embodiment of the method according to the invention it is envisaged that the trimming of the intake tract can be set by means of at least one variable intake manifold or by means of at least one adjustable swirl flap or by means of at least one resonator component. However, it is also possible to provide a combination of a plurality of the abovementioned components, by means of which the trimming of the intake tract can be adjusted or set. For this purpose, an actuating unit which is driven by means of actuator and by means of which the length of one or more intake manifolds or the position of one or more swirl flaps can be varied in accordance with the respective operating point of the internal combustion engine can be provided, for example. This has the advantage that the trimming of the intake tract can be set and, where applicable regulated, in an optimized manner for the respective operating point in the course of operation.

It has proven to be advantageous for the intake frequency or a multiple of the intake frequency, i.e. the 1st harmonic, the 2nd harmonic, the 3rd harmonic etc., to be chosen as selected signal frequencies. At these signal frequencies, the dependence of the respective characteristic of the pressure oscillation signal on the trimming of the intake tract is particularly clearly evident.

In order, in a refinement of the method, to further increase the accuracy of the determination of the value of the trimming of the intake tract in an advantageous manner, it is possible for additional operating parameters of the internal combustion engine to be taken into consideration in the determination of the trimming of the intake tract. For this purpose, at least one of the further operating parameters temperature of the intake medium in the inlet tract, temperature of a coolant used for cooling the internal combustion engine and engine speed of the internal combustion engine, may be taken into consideration in the determination of the trimming of the intake tract.

The temperature of the intake medium, that is to say substantially of the intake air, directly influences the speed of sound in the medium and thus the pressure propagation in the intake tract. This temperature can be measured in the inlet tract and is therefore known. The temperature of the coolant can also influence the speed of sound in the intake medium owing to heat transfer in the intake tract and in the cylinder. This temperature is generally also monitored and, for this purpose, measured, and is thus available in any case and can be taken into consideration in the determination of the current trimming of the intake tract.

The engine speed is one of the variables that characterizes the operating point of the internal combustion engine, and influences the time available for the pressure propagation in the intake tract. The engine speed is also constantly monitored and is thus available for the determination of the trimming of the intake tract.

The abovementioned additional parameters are thus available in any case, or can be determined in a straightforward manner. The respective influence of the stated parameters on the respective characteristic of the selected signal frequency of the pressure oscillation signal is in this case assumed to be known, and, as already noted above, has been determined for example during the measurement of a reference internal combustion engine and jointly stored in the reference value characteristic maps. Incorporation by means of corresponding correction factors or correction functions in the calculation of the current values of the trimming of the intake tract by means of an algebraic model function also constitutes a possibility for taking these additional, further operating parameters into consideration in the implementation of the method according to the invention.

For the implementation of the method according to the invention, it is furthermore advantageously possible for the dynamic pressure oscillations in the intake tract to be measured by means of a standard pressure sensor, e.g.

directly in the intake manifold. This has the advantage that no additional pressure sensor is required, which represents a cost advantage.

In a further embodiment example, for the implementation of the method according to the invention, the crankshaft position feedback signal may be determined by means of a toothed gear and a Hall sensor, wherein this is a customary sensor arrangement, which is possibly present in the internal combustion engine in any case, for detecting the crankshaft revolutions, i.e. the speed of the internal combustion engine. The toothed gear is in this case arranged for example on the outer circumference of a flywheel or of the crankshaft timing adapter 10 (see also FIG. 1). This has the advantage that no additional sensor arrangement is required, which represents a cost advantage.

Figure 6:
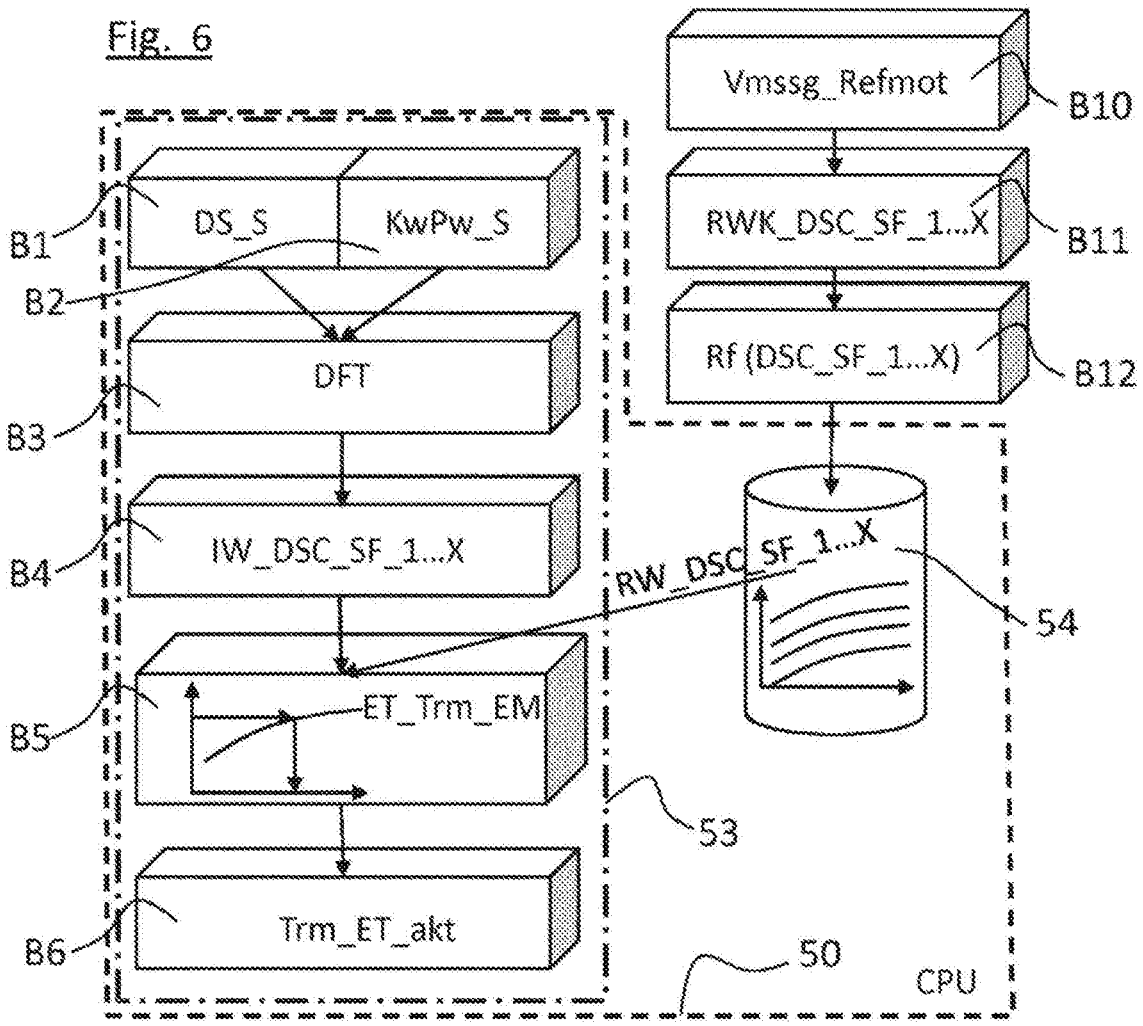
FIG. 6 shows a block diagram for schematic illustration of one embodiment of the method according to the invention.

FIG. 6 illustrates an embodiment of the method according to the invention for determining the current trimming of the intake tract of an internal combustion engine during operation, once again in the form of a simplified block diagram showing the significant steps.

The border shown by dashed lines around the corresponding blocks B1 to B6 and 54 in the block diagram symbolically represents the boundary between an electronic, programmable engine control unit 50, e.g. of an engine control unit referred to as a CPU, of the respective internal combustion engine, on which the method is executed. This electronic engine control unit 50 contains, inter alia, the electronic processing unit 53 and the electronic memory area 54 for executing the method according to the invention.

At the start, dynamic pressure oscillations, assignable to the respective cylinder, of the intake air in the intake tract and/or of the exhaust gas in the outlet tract of the respective internal combustion engine are measured during operation and a corresponding pressure oscillation signal (DS_S) is generated from these, and a crankshaft phase angle signal (KwPw_S) is determined at the same time, i.e. in time dependence, as illustrated by the blocks arranged in parallel, which are denoted by B1 and B2.

Then, using discrete Fourier transformation symbolized by the block denoted by B3, an actual value (IW_DSC_SF_1 . . . X) of at least one characteristic of at least one selected signal frequency of the measured pressure oscillations in relation to the crankshaft phase angle signal (KwPw_S) is determined from the pressure oscillation signal (DS_S), this being illustrated by the block denoted by B4.

On the basis of the at least one determined actual value (IW_DSC_SF_1 . . . X) of the respective characteristic, intake tract trimming determination (ET_Trm_EM) is then carried out in block B5. This is accomplished taking into consideration reference values (RW_DSC_SF_1 . . . X) of the respectively corresponding characteristic of the respectively identical signal frequency for different trimmings of the intake tract, which are made available in the memory area denoted by 54 or are determined in real time with the aid of the algebraic model functions stored in the memory area 54. The current value, determined in this way, of the trimming of the intake tract (Trm_ET_akt) of the internal combustion engine is then made available in block B6.

FIG. 6 furthermore shows, in blocks B10, B11 and B12, the steps which precede the method described above. In block B10, a reference internal combustion engine (Vmssg_Refmot) is measured in order to determine reference values of the respective characteristic of the respectively selected signal frequency of the measured pressure oscillations in relation to the crankshaft phase angle signal from the pressure oscillation signal by means of discrete Fourier transformation. In block B11, the determined reference values are then collated in reference value characteristic maps (RWK_DSC_SF_1 . . . X) as a function of the associated values of the trimming of the intake tract and are stored in the electronic memory area 54 of the engine control unit 50 denoted by CPU.

The block denoted by B12 contains the derivation of algebraic model functions (Rf(DSC_SF_1 . . . X)), which, as reference value functions, reproduce, for example, the profile of the respective reference value curves of the respective characteristic of the pressure oscillation signal for a respective signal frequency as a function of the trimming of the intake tract, on the basis of the previously determined reference value characteristic maps (RWK_DSC_SF_1 . . . X). It is then likewise possible, as an alternative or in addition, for these algebraic model functions (Rf(DSC_SF_1 . . . X)) to be stored in the electronic memory area 54, denoted by 54, of the engine control unit 50 denoted by CPU, where they are available for implementing the above-explained method according to the invention.

Summarized briefly once again, the essence of the method according to the invention for determining the current trimming of the intake tract of an internal combustion engine is a method in which dynamic pressure oscillations in the intake tract or outlet tract of the respective internal combustion engine are measured during normal operation, and from these, a corresponding pressure oscillation signal is generated. At the same time, a crankshaft phase angle signal is determined and set in relation to the pressure oscillation signal. From the pressure oscillation signal, an actual value of at least one characteristic of at least one selected signal frequency of the measured pressure oscillations in relation to the crankshaft phase angle signal is determined, and the current trimming of the intake tract or a value for the current trimming of the intake tract is determined on the basis of the determined actual value taking into consideration reference values of the corresponding characteristic of the respectively identical signal frequency for different trimmings of the intake tract.

The invention claimed is:

1. A method for determining a current trimming of an intake tract of an internal combustion engine during operation, the method comprising:

measuring, by a pressure sensor, dynamic pressure oscillations of a cylinder of the internal combustion engine at a defined operating point during normal operation, the pressure sensor positioned in the intake tract or in an outlet tract of the internal combustion engine, simultaneously:

generating, at an electronic control unit, a pressure oscillation signal from the measured dynamic pressure oscillations, and determining, at the electronic control unit, a crankshaft phase angle signal of the internal combustion engine, determining, at the electronic control unit, an actual value of a characteristic of a selected signal frequency of the measured dynamic pressure oscillations in relation to the crankshaft phase angle signal based on the pressure oscillation signal and using discrete Fourier transformation, determining, at the electronic control unit, the current trimming of the intake tract of the internal combustion engine based on the actual value of the characteristic and reference value characteristic maps stored in a memory of the electronic control unit, the reference value characteristic maps including reference values of the characteristic of the selected signal frequency corresponding to different trimmings of the intake tract, and modifying, at the electronic control unit, control parameters of the internal combustion engine based on the current trimming of the intake tract of the internal combustion engine.

2. The method as claimed in claim 1, further comprising:

providing the reference values of the characteristic of the selected signal frequency as a function of the current trimming of the intake tract in the reference value characteristic maps, or providing an algebraic model function for a mathematical determination of the reference values of the characteristic of the selected signal frequency, the algebraic model function representing a relationship between the characteristic of the selected signal frequency and the current trimming of the intake tract.

3. The method as claimed in claim 2, further comprising:

storing the reference value characteristic maps or the algebraic model function in the memory of the electronic processing unit.

4. The method as claimed in claim 2, further comprising:

determining the reference values of the characteristic of the selected signal frequency in advance on a reference internal combustion engine as a function of the different trimmings of the intake tract.

5. The method as claimed in claim 4, further comprising:

deriving the model function representing the relationship between the characteristic of the selected signal frequency and the current trimming of the intake tract from the reference values of the characteristic of the selected signal frequency and associated trimmings of the intake tract.

6. The method as claimed in claim 5, wherein the reference values of the characteristic of the selected signal frequency that are determined in advance are based on a measurement of the reference internal combustion engine at at least one defined operating point while specifying certain reference trimmings of the intake tract, wherein determining the reference values of the characteristic of the selected signal frequency comprises:

measuring dynamic pressure oscillations, assignable to one cylinder of the reference internal combustion engine, in the intake tract or in the outlet tract during operation, generating a pressure oscillation signal corresponding to the dynamic pressure oscillations, at the same time, determining a crankshaft phase angle signal, determining the reference values of the characteristic of the selected signal frequency of the measured dynamic pressure oscillations in relation to the crankshaft phase angle signal based on the pressure oscillation signal using discrete Fourier transformation, and storing the determined reference values as a function of the associated trimmings of the intake tract in the reference value characteristic maps.

7. The method as claimed in claim 1, wherein the characteristic of the selected signal frequency includes a phase position or an amplitude, or a phase position and an amplitude of at least one selected signal frequency is.

8. The method as claimed in claim 1, further comprising:

adjusting the trimming of the intake tract by at least one variable intake manifold, by at least one adjustable swirl flap, by at least one resonator component, or by a combination of a plurality of the at least one variable intake manifold, the at least one adjustable swirl flap, and the at least one resonator component.

9. The method as claimed in claim 1, wherein the selected signal frequencies include an intake frequency or a multiple of the intake frequency.

10. The method as claimed in claim 1, wherein, the current trimming of the intake tract of the internal combustion engine is determined based on at least one selected from the group of a temperature of an intake medium in the intake tract, a temperature of a coolant used for cooling the internal combustion engine, and an engine speed of the internal combustion engine.

11. The method as claimed in claim 1, further comprising:

determining a crankshaft position feedback signal by a toothed gear and a Hall sensor.

12. The method as claimed in claim 1, wherein the electronic processing unit is part of an engine control unit for controlling the internal combustion engine, and wherein the method further comprises:

performing, at the engine control unit, an adaptation of further control variables or control routines for control of the internal combustion engine as a function of the determined current trimming of the intake tract.

13. An engine control unit for at least partly controlling an internal combustion engine, the engine control unit comprising:

an electronic processing unit; and a memory unit storing instructions that when executed cause the electronic processing unit to perform a method, the method comprising:

receiving, from a pressure sensor, dynamic pressure oscillations of a cylinder of the internal combustion engine at a defined operating point during normal operation, in an intake tract or in an outlet tract of the internal combustion engine, simultaneously:

generating a corresponding pressure oscillation signal from the received dynamic pressure oscillations, and determining a crankshaft phase angle signal of the internal combustion engine, determining an actual value of a characteristic of a selected signal frequency of the received dynamic pressure oscillations in relation to the crankshaft phase angle signal based on the pressure oscillation signal and using discrete Fourier transformation, determining a current trimming of the intake tract of the internal combustion engine based on the actual value of the characteristic of the selected signal frequency and reference value characteristic maps stored in the memory unit, the reference value characteristic maps including reference values of the characteristic of the selected signal frequency corresponding to different trimmings of the intake tract, and modifying control parameters of the internal combustion engine based on the current trimming of the intake tract of the internal combustion engine.

14. The engine control unit of claim 13, wherein the method further comprises:

providing the reference values of the characteristic of the selected signal frequency as a function of the current trimming of the intake tract in at least one reference value characteristic map from the reference value characteristic maps, or providing an algebraic model function for a mathematical determination of the reference values of the characteristic of the selected signal frequency, the algebraic model function representing a relationship between the characteristic of the selected signal frequency and the current trimming of the intake tract.

15. The engine control unit of claim 14, wherein the method further comprises:

storing the at least one reference value characteristic map or the algebraic model function in the memory unit.

16. The engine control unit of claim 14, wherein the method further includes:

determining the reference values in advance on a reference internal combustion engine as a function of the different trimmings of the intake tract.

17. The engine control unit of claim 16, wherein the method further includes:

deriving the algebraic model function representing the relationship between the characteristic of the selected signal frequency and the trimming of the intake tract is in each case derived from the reference values and associated trimmings of the intake tract.

18. The engine control unit of claim 17, wherein the reference values of the characteristic of the selected signal frequency that are determined in advance are based on a measurement of the reference internal combustion engine at at least one defined operating point while specifying certain reference trimmings of the intake tract, wherein determining the reference values of the characteristic of the selected signal frequency comprises:

measuring dynamic pressure oscillations, assignable to one cylinder of the reference internal combustion engine, in the intake tract or in the outlet tract during operation, and generating a corresponding pressure oscillation signal, at the same time, determining a crankshaft phase angle signal, determining the reference values of the characteristic of the selected signal frequency of the measured dynamic pressure oscillation in relation to the crankshaft phase angle signal from the pressure oscillation signal using discrete Fourier transformation, and storing the determined reference values as a function of the associated trimmings of the intake tract in the reference value characteristic maps.

* * * * *